United States Patent [19]

Gunsolus

[11] 4,429,848

[45] Feb. 7, 1984

[54] SURGICAL HANGER

[76] Inventor: Chee C. Gunsolus, 3402 SE. Inlet Harbor Trail, Stuart, Fla. 33494

[21] Appl. No.: 339,371

[22] Filed: Jan. 15, 1982

[51] Int. Cl.[3] ..... A62C 23/04

[52] U.S. Cl. ..... 248/75; 248/89; 248/305

[58] Field of Search ..... 248/75, 89, 92, 304, 248/305, 215, 216.4, 340, 100, 339; 24/133; 119/18, 51 R; 292/107

[56] References Cited

U.S. PATENT DOCUMENTS

| | | | |
|---|---|---|---|
| 565,052 | 8/1896 | Thompson | 248/339 |
| 890,854 | 6/1908 | Foote | 248/304 |
| 1,585,547 | 5/1926 | Jones . | |
| 1,831,717 | 11/1931 | Muniente | 248/340 |
| 2,107,693 | 2/1938 | Finch | 248/305 |
| 2,245,126 | 6/1941 | Day | 248/339 |
| 2,288,706 | 7/1942 | Herr . | |
| 2,624,201 | 1/1953 | Thomson | 248/304 |
| 3,870,267 | 3/1975 | Okle | 248/339 |
| 3,891,176 | 6/1975 | Downing et al. | 248/340 |
| 4,247,070 | 1/1981 | Dirksing | 248/215 |

FOREIGN PATENT DOCUMENTS

| | | | |
|---|---|---|---|
| 1050517 | 2/1959 | Fed. Rep. of Germany | 248/339 |

*Primary Examiner*—William H. Schultz
*Assistant Examiner*—Ramon O. Ramirez
*Attorney, Agent, or Firm*—Schmidt, Johnson, Hovey & Williams

[57] ABSTRACT

A simple yet highly effective hanger device is provided which is especially designed for temporarily holding in place elongated power lines and hoses found in surgical operating rooms. The hanger broadly includes an elongated strip of rigid material having respective, oppositely extending terminal hook portions, and a releasable latch element positioned adjacent one of the terminal hooks. In preferred forms, the hanger is of integral construction, and includes one or more obliquely extending wire-supporting clips intermediate the ends thereof.

7 Claims, 3 Drawing Figures

SURGICAL HANGER

BACKGROUND OF THE INVENTION

1. Field of the Invention

This invention relates to a surgical hanger having a number of advantages rendering it specially adapted for use in operating rooms, including easy portability, compactness, and the ability to be rendered sterile for use in such envirnoments. More particularly, it is concerned with a surgical hanger preferably formed of a single strip of rigid metallic material and having a generally flat intermediate portion, terminal ends in the form of oppositely extending, arcuate hooks, and a releaseable latch element in partially blocking relationship to the open end of one of the terminal hooks.

2. Description of the Prior Art

The typical surgical operating room is characterized by a large number of elongated hoses, power cords and other paraphernalia. As can be appreciated, in order to create the safest possible conditions in an operating room, it is essential that such cords be properly supported and/or stowed so that they do not present a danger to the patient or hospital personnel. At the same time, all equipment used in the operating room must be rendered and maintained sterile during the operation procedure, for the protection of the patient. Therefore, expedience which would typically be used in a non-sterile environment may not be adaptable for the demanding conditions of an operating room.

Various hangers and hooks of different configurations have been developed in the past, although none are known which are specifically designed for use in operating rooms. Patent describing such prior structures include U.S. Pat. Nos. 1,902,241, 2,107,693, 1,585,547, 1,873,039, 3,112,911 and 2,288,706.

SUMMARY OF THE INVENTION

In its broadest aspects, the present invention is concerned with a surgical hanger specially designed for use in operating rooms, and particularly in and around large three-dimensional X-ray devices used in pelvic and hip orthopedic surgery; such X-ray devices conventionally require a number of elongated service cords which must be properly suspended to avoid kinking and the like, and to maintain these lines out of interfering relationship with the surgical work to be performed.

The hanger hereof includes an elongated strip of rigid material presenting an intermediate portion and respective terminal end portions which are bent out of the plane of the intermediate portion in the form of terminal hooks, along with a releasable latch cooperatively positioned adjacent at least one of the hooks for releasably securing a hose or the like within the hook.

The hanger is preferably formed of a unitary strip of metal material, and includes at least one upstanding, obliquely oriented clip affixed to the strip intermediate the ends thereof.

DESCRIPTION OF THE PREFERRED EMBODIMENT

Figure 3:
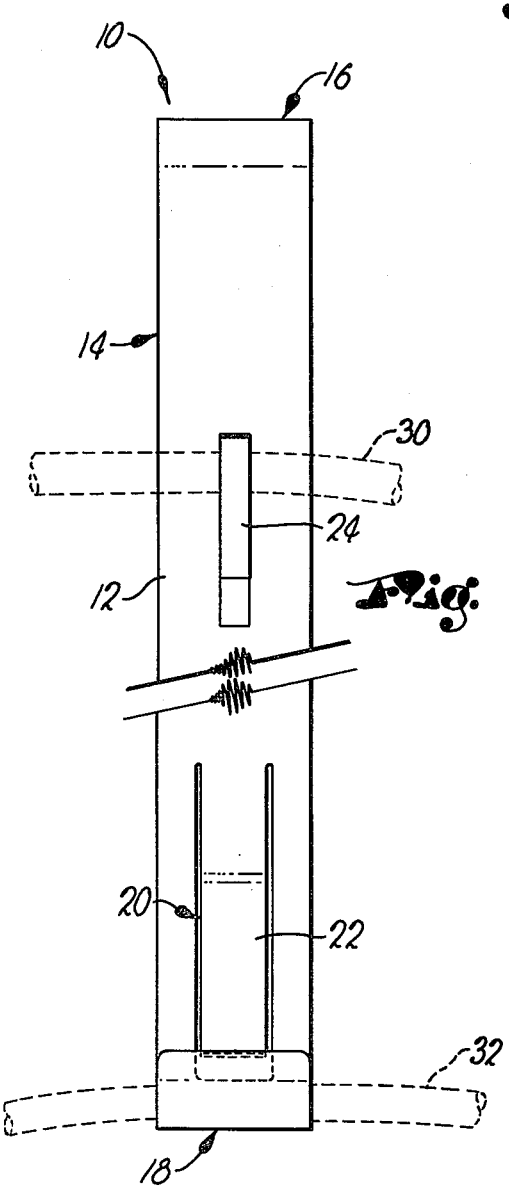
FIG. 3 is a fragmentary front view of a hanger in accordance with the invention, with service lines supported by the hanger being illustrated in phantom.
Figure 2:
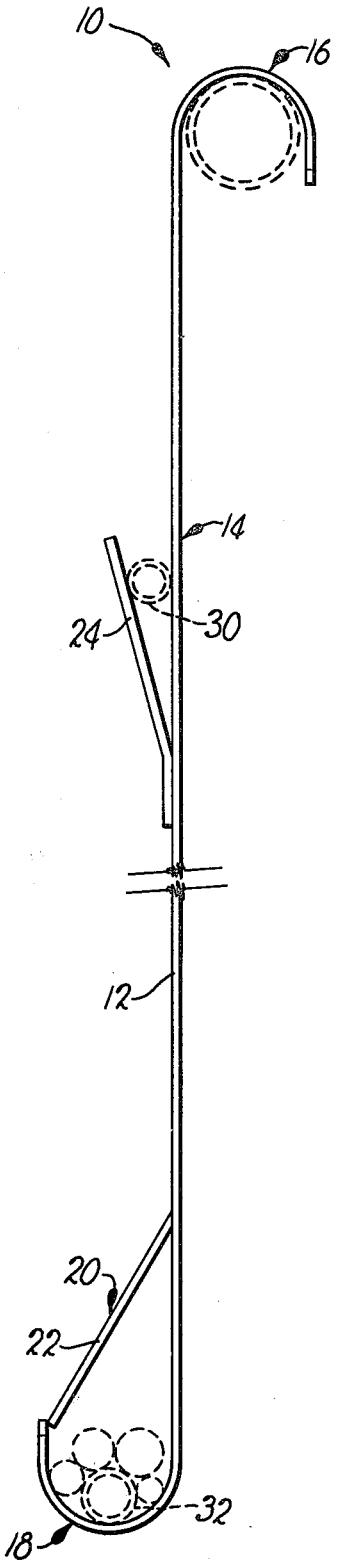
FIG. 2 is an enlarged, fragmentary side view of one of the hangers illustrated in FIG. 1, with the various service lines and the upper support bar for the hanger being depicted in phantom.

Turning now to the drawing, a surgical hanger 10 is illustrated in FIGS. 2 and 3. The hanger 10 includes an elongated strip 12 of thin metallic material which presents a substantially straight, flat intermediate portion 14 and respective terminal end portions 16, 18 which are bent out of the plane of portion 14 to present arcuate hooks. It will be noted in this regard (see FIG. 2) that the terminal hooks project in opposite directions from the intermediate portion 14, with the upper hook opening downwardly and the lower hook opening upwardly.

The hanger 10 further includes a releasable latch 20 cooperatively positioned adjacent end portion 18. The latch is in the form of an elongated, tongue-like element 22 which is cut from intermediate portion 14 and has a segment thereof obliquely oriented and extending to a point adjacent the upper end of the lower hook. As can be seen, the element 22 is normally in at least partially blocking relationship to the open end of the lower hook, but is shiftable to a limited degree in order to allow access to the hook.

The hanger 10 is further provided with at least one elongated clip 24 which may be welded or pivoted to the strip 12 intermediate the ends thereof. The clip as shown is in the form of an elongated web, and is oriented in an upstanding, oblique position with the upper end thereof laterally spaced from the strip 12.

Figure 1:
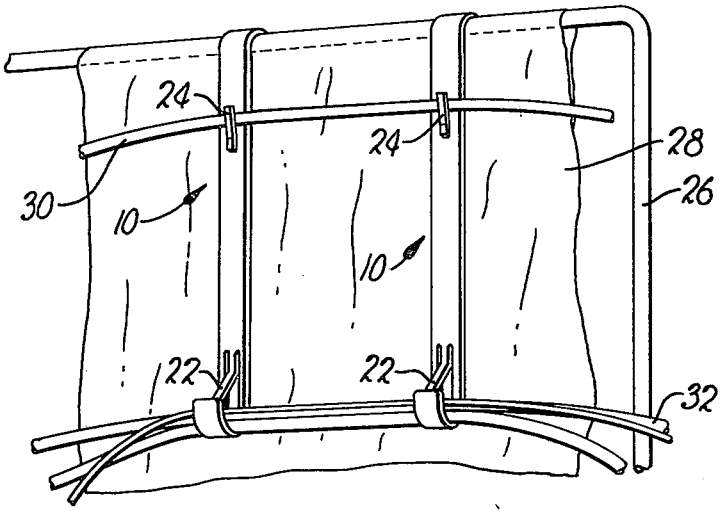
FIG. 1 is an elevational view illustrating a pair of surgical hangers in accordance with the invention, depicted in use thereof temporarily suspended and supporting various service lines in an operating room.

FIG. 1 illustrates a typical environment of use of hangers in accordance with the invention. Specifically, an upright, tubular support 26 of inverted U-shape configuration is provided, and respective hangers 10 are suspended from the upper, horizontally extending segment of the support 26 as illustrated. A cloth curtain 28 may also be suspended from the support 26 as shown, with the hangers 10 being disposed on the outside of the curtain 28. An elongated electrical cord 30 is supported by the spaced apart hangers 10, and specifically by the clips 24 thereof. Moreover, elongated air hoses and other service lines broadly referred to by the numeral 32 are supported in the lower hooks of the hangers 10. The service lines are placed within the lower hooks simply by depressing the latching elements 22 downwardly until the lines can be situated within the respective hooks. At this point, the elements spring back to their normal position illustrated in FIG. 2, in order to maintain the service lines within the lower hooks and to prevent inadvertent removal thereof.

It will, of course, be apparent to those skilled in the art that any number of hangers 10 can be used, depending upon the number and extent of support required for the elongated service lines. Furthermore, the metallic construction of the hangers permits sterilization thereof using conventional equipment, so that the hangers do not contaminate a surgical operating area.

I claim:

1. A hanger comprising:

an elongated strip of rigid material having an intermediate portion and terminal end portions bent out of the plane of said intermediate portion in the form of terminal hooks; and a releasable latch cooperatively positioned adjacent at least one of said hooks for releasably securing a hose or the like within said one hook, said latch comprising an elongated shiftable element normally in at least partial blocking relationship to the open end of said one hook, said element being integral with said strip and projecting obliquely therefrom.

2. The hanger of claim 1, said strip being generally flat and of unitary construction.

3. The hanger of claim 1, at least one upstanding, obliquely oriented clip affixed to said strip intermediate said end portions.

4. The hanger of claim 3, said clip being located on the same side of said strip as said releasable latch.

5. The hanger of claim 1, said terminal end portions being bent in opposite directions to form respectively oppositely projecting terminal hooks.

6. The hanger of claim 1, said strip being formed of metal.

7. A hanger comprising a flat, unitary strip of rigid material having an intermediate portion, terminal end portions bent out of the plane of said intermediate portion in opposite directions to form respective, oppositely outwardly projecting terminal hooks, a releasable latch cooperatively positioned adjacent at least one of said hooks for releasably securing a hose or the like within said one hook, said latch comprising an elongated, shiftable element integral with said strip and projecting obliquely therefrom, said element normally being in at least partial blocking relationship to the open end of said one hook, and at least one upstanding, obliquely oriented clip located on the same side of said strip as said releasable latch.

* * * * *